US008877010B2

(12) United States Patent
Sarén

(10) Patent No.: US 8,877,010 B2
(45) Date of Patent: Nov. 4, 2014

(54) MODELLING OF A PROPERTY OF PAPER, PAPERBOARD OR BOARD

(75) Inventor: Matti-Paavo Sarén, Kajaani (FI)

(73) Assignee: Metso Automation Oy, Vantaa (FI)

( * ) Notice: Subject to any disclaimer, the term of this patent is extended or adjusted under 35 U.S.C. 154(b) by 37 days.

(21) Appl. No.: 13/262,703

(22) PCT Filed: Mar. 31, 2010

(86) PCT No.: PCT/FI2010/050254
§ 371 (c)(1),
(2), (4) Date: Nov. 30, 2011

(87) PCT Pub. No.: WO2010/116030
PCT Pub. Date: Oct. 14, 2010

(65) Prior Publication Data

US 2012/0072000 A1 Mar. 22, 2012

(30) Foreign Application Priority Data

Apr. 7, 2009 (FI) ..... 20095381

(51) Int. Cl.
*D21G 9/00* (2006.01)

(52) U.S. Cl.
CPC ..... *D21G 9/0018* (2013.01); *D21G 9/0027* (2013.01); *D21G 9/0009* (2013.01); *D21G 9/0054* (2013.01)
USPC ..... 162/198; 162/232; 162/238; 700/128; 700/104; 706/12

(58) Field of Classification Search
CPC .. D21G 9/0009; D21G 9/0018; D21G 9/0027
USPC ..... 162/232, 238, 198; 700/128, 104; 706/12
See application file for complete search history.

(56) References Cited

U.S. PATENT DOCUMENTS 3,873,416 A * 3/1975 Forgacs et al. ..... 162/49
4,318,180 A 3/1982 Lundqvist et al.

(Continued)

FOREIGN PATENT DOCUMENTS

EP 1 023 648 B1 6/2004
JP A-1-162890 6/1989
WO WO 2007/122289 A1 11/2007

OTHER PUBLICATIONS

Rudd, "Virtual Online Analyzer (VOA)—Solutions for Paper Machine Property Measurements," Papermakers Conference Recycling Symposium and Process Control Electrical and Information Conference, 1999, vol. 1, pp. 323-328.
Zeyu et al., "Adaptive Calibration of Surrogate Measurements and Its Application to the Control of Moisture Content in Paper Manufacturing," Proceedings of the 2004 American Control Conference, 2004, vol. 4, pp. 3203-3208.

(Continued)

*Primary Examiner* — Jacob Thomas Minskey
(74) *Attorney, Agent, or Firm* — Oliff PLC

(57) ABSTRACT

Properties of an end product, such as paper, paperboard or board, are important for the user of the end product. To be able to manufacture an end product of desired quality, it is important to know what kind of paper pulp used for manufacturing the end product results in a particular kind of property of the end product. Embodiments provide a method and an apparatus for generating a model, which model connects at least one property of the end product with at least one property of the paper pulp. On the basis of the model, also the manufacturing process can be controlled.

10 Claims, 3 Drawing Sheets

(56) References Cited

U.S. PATENT DOCUMENTS

| | | | | |
|---|---|---|---|---|
| 5,013,403 | A | 5/1991 | Chase | |
| 5,087,823 | A * | 2/1992 | Silvy et al. | 250/573 |
| 5,638,284 | A | 6/1997 | Helmer et al. | |
| 6,351,676 | B1 * | 2/2002 | Thomas | 700/28 |
| 6,398,914 | B1 * | 6/2002 | Furumoto | 162/198 |
| 6,493,601 | B1 | 12/2002 | Wells et al. | |
| 6,517,680 | B1 * | 2/2003 | Fredlund et al. | 162/198 |
| 7,082,348 | B1 | 7/2006 | Dahlquist et al. | |
| 2005/0145357 | A1 | 7/2005 | Muench et al. | |

OTHER PUBLICATIONS

Finnish Search Report in Finnish Patent Application No. 20095381; dated Mar. 7, 2010 (with English-language translation).

International Search Report in International Application No. PCT/FI2010/050254; dated Jul. 16, 2010.

International Preliminary Report on Patentability in International Application No. PCT/FI2010/050254; dated Aug. 10, 2011.

Japanese Office Action mailed Mar. 4, 2014 from Japanese Patent Application No. 2012-504039 (with English-language translation).

* cited by examiner

MODELLING OF A PROPERTY OF PAPER, PAPERBOARD OR BOARD

FIELD

The invention relates to modelling a property of an end product, such as paper, paperboard or board, and particularly to the use of fractionation of a raw material, such as fibre-water suspension, which is used for manufacturing the end product, in modelling a given paper-technical property of the end product.

BACKGROUND

Generally, the aim of papermaking is to manufacture paper which corresponds to the quality desired by a customer. Paper quality may be expressed with several different parameters, such as tensile strength, basis weight and surface properties of the paper. The above-mentioned paper-technical properties of paper depend on several factors, including the quality of the paper pulp used for papermaking, for example. Paper pulp is used in papermaking by feeding pulp onto the wire of a paper machine and by drying the pulp into paper. Paper pulp may be manufactured by, for example, chemically or mechanically separating cellulose from wood. Pulp may also be manufactured of recycled fibre, such as newsprint, by means of a recycled fibre process. Further, it is obvious that the paper quality depends, to a great extent, on different operations of the paper machine producing the paper.

Paper pulp is thus an intermediate product used in manufacturing paper, paperboard or board, containing fibre suspension, such as cellulose, minerals and chemicals. However, most of the paper pulp is water, which disperses the fibre and makes it pliable.

Since paper pulp may be produced in several different ways and there are several different processes affecting its manufacture, it is obvious that paper pulps produced in different ways may have very different properties. Therefore, a paper-technical property of paper, paperboard or board produced as an end product may vary a lot, depending on the properties of the paper pulp used. It is thus extremely challenging to assess the value of a paper-technical property of an end product if the quality of the paper pulp cannot be determined accurately. There have been attempts to solve this problem by keeping the quality of paper pulp stable and, in this way, to obtain paper, paperboard or board of given quality.

A problem in the arrangement described above is that keeping the properties of paper pulp stable is challenging, and when a customer wishes to have paper, paperboard or board of given quality, searching for properties of paper pulp providing the desired quality is work that takes time and resources. Thus, in order to produce an end product of the desired type and quality, it is important to provide a solution by means of which this is possible without excessively wasting resources.

BRIEF DESCRIPTION

An object of the invention is thus to provide a method and an apparatus implementing the method in such a way that the above problems can be solved. The object of the invention is achieved with a method and an arrangement characterized by what is stated in the independent claims.

Advantages of the method and the apparatus implementing the method according to the invention include, for instance, control of the end product in real time.

BRIEF DESCRIPTION OF THE FIGURES

The invention will now be described in greater detail in connection with preferred embodiments, referring to the attached drawings, of which.

DESCRIPTION OF EMBODIMENTS

Figure 1:
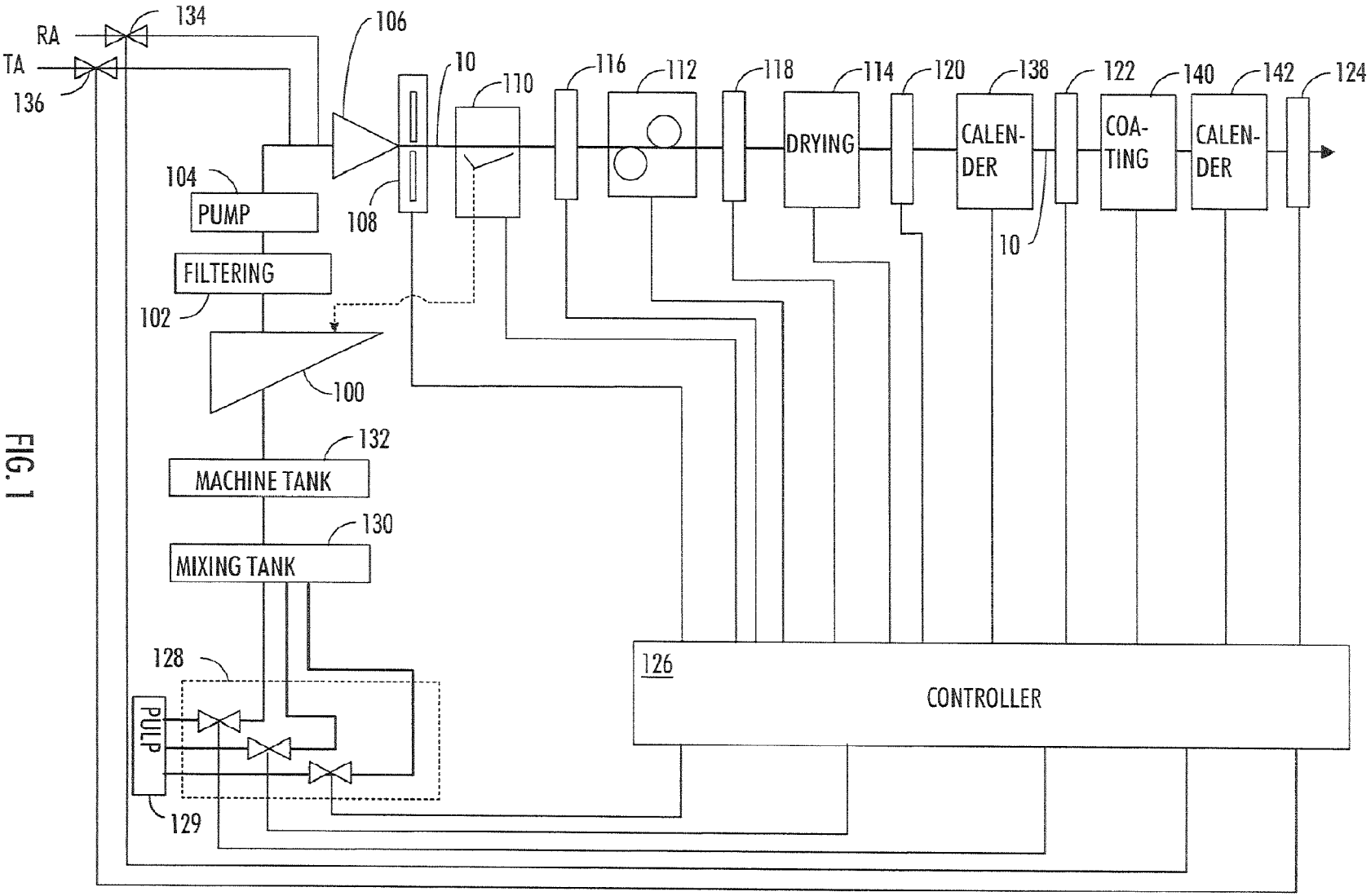
FIG. 1 shows the general structure of a paper machine.

FIG. 1 shows the principled structure of a paper machine. One or more pulps are fed into a paper machine via a wire well 100, which is usually preceded by a mixing tank 130 of pulp parts and a machine tank 132. Machine pulp is batched to short circulation, controlled by basis weight control or a grade change program, for example. The mixing tank 130 and the machine tank 132 may be replaced by a separate mixing reactor (not shown in FIG. 1), and the batching of machine pulp is controlled by the feed of each pulp part separately by means of valves or another flow control member 128. In the wire well 100, water is mixed into the machine pulp in order to obtain a desired consistency for the short circulation. Water may be circulated in the paper machine in such a way that the water used for diluting paper pulp is obtained from a former 110 (broken line from the former 110 to the wire well 100). Purifying apparatuses 102 may be used to remove sand (vortex cleaners), air (air removal tank) and other coarse material (pressure screen) from the generated pulp, and pulp is pumped into a headbox 106 by means of a pump 104. Before the headbox 106, filling agent TA including, for instance, kaoline, calcium carbonate, talc, chalk, titanium oxide and infusorial earth etc. and/or retention agent RA including inorganic, natural organic or synthetic water-soluble organic polymers, may be added to the pulp, if required. The filling agent allows the formation, surface properties, opacity, brightness and printability to be improved and the manufacturing costs to be reduced. Retention agents RA, in turn, increase the retention of the fines and filling agents and simultaneously accelerate water removal in a manner known as such. Both the filling agents and the retention agents as well as the paper pulp and its chemistry affect the topography of the surface of the web and paper.

A headbox 106 is the first part of the starting part of the paper machine, having the task of feeding paper pulp onto the wire to form a web. The headbox 106 tends to generate turbulence when feeding paper pulp to form a web. By means of turbulence, the fibres of the paper pulp are formed into a web as uniformly as possible, and not merely in the direction of the wire. Before the feed, the pulp in the headbox 106 is intensely agitated in order for the fibre bundles to disintegrate. The agitation and the generation of turbulence may take place by means of a high rotation speed of a screen-type roll, as in a rectifier-roll headbox, or by means of a tapering flow channel, as in a hydraulic headbox. Before the headbox 106, there are usually components 129 affecting the pulp to be moved into the paper box. Such a component may be, for example, a refiner and/or a screen (not shown in FIG. 1), with which the pulp to be moved into the headbox 106 is treated. The purpose of refiners is to treat the fibres in such a way, for example, that their surface structure would allow better bonding than before or that their mechanical properties would change along desired lines. By means of screens, pulp may be divided into different fractions which may be processed separately to obtain desired properties.

From the headbox 106, the pulp is fed via a slice 108 of the headbox to the former 110, which may be a fourdrinier wire, a gap former, a hybrid former or a cylindrical former. In the former 110, water is removed from a web 10, and in addition, ash, fines and fibres are removed to the short circulation. In the former 110, the pulp is fed onto the wire to form a web 10, and the web 10 is preliminarily dried and pressed in a press 112. In the press, the paper pulp moves between two felts, and while the paper is moving through the felts, water is removed from the paper pulp into the felts. There may also be more than two felts in one press part. The felts are cleaned in the felt circulation, whereby it is again ready to remove water from the paper pulp. The web 10 is actually dried in drying apparatuses 14, which may be of different types. The most common type is a cylinder drying method in which the web travels on the surface of large heated cylinders. Since the surface of the cylinder is warm, the water is evaporated from the web. The steam generated is collected off the cylinder to be used in other operations of the paper machine. Other drying forms include, for instance, through drying or infrared drying.

The paper machine, which refers, in the context of this application, to paper, paperboard and board machines as well as cellulose-manufacturing machines, may further comprise a pre-calender 138, a coating part 140 and/or a post-calender 142. However, there is not necessarily any coating part 140, whereby it is not necessary to have more than one calender 138, 142. In the coating part 140, coating slip may be applied onto the surface of the paper, which slip may contain kaoline, talc or carbonate, starch and/or latex. The use of coating slip usually decreases the roughness of the paper and increases the glossiness.

In the calender 138, 142, where the uncoated or coated paper web moves between rolls pressing with a desired force, the surface topography of the paper, such as roughness, may be changed. The calender 138, 142 may also affect the thickness and/or gloss of the paper. In the calender 138, 142, properties of the paper web may be changed by means of moistening of the web, the temperature and the nip loading between the rolls in such a way that the greater the pressing directed at the web, the smoother and glossier the paper. Moistening and rising the temperature further decrease the roughness and increase the glossiness.

Having been treated as desired, the paper may be rolled into a machine reel in a reel-up unit. In addition to this, it is obvious that the operation of a paper machine is known as such to a person skilled in the art, and thus it is not described in greater detail in this context.

FIG. 1 also shows a control arrangement of a paper machine. Factors relating to the quality include the number of pulp parts and their proportion to each other, the amount of filling agent, the amount of retention agent, machine speed, the amount of wire water and the drying efficiency. A controller 126 may control the batching of the pulp parts by means of valves 128, the batching of the filling agent TA by means of a valve 136, the batching of the retention agent RA by means of a valve 134, control the size of the slice 108, control the machine speed, control the amount of wire water and the drying process in block 114. The controller 126 also utilizes measuring devices 116 to 120 to monitor the control measures, the quality and/or the grade change. At least one measuring part 116 to 124 may be used to measure the surface topography of the web 10. The controller 126 may also measure the properties of the web 10 in other parts (for example at the same points where the control measures are taken).

The controller 126 may be regarded as a control arrangement based on automatic data processing of the paper machine or a part of it. The controller 126 may receive digital signals or convert the analogue signals it has received into digital ones. The controller 126 may comprise a microprocessor and memory and carry out the signal processing in accordance with an appropriate computer program. The principle of the controller 126 may be, for instance, a PID (Proportional-Integral-Derivative), MPC (Model Predictive Control) or GPC control (General Predictive Control).

Figure 2:
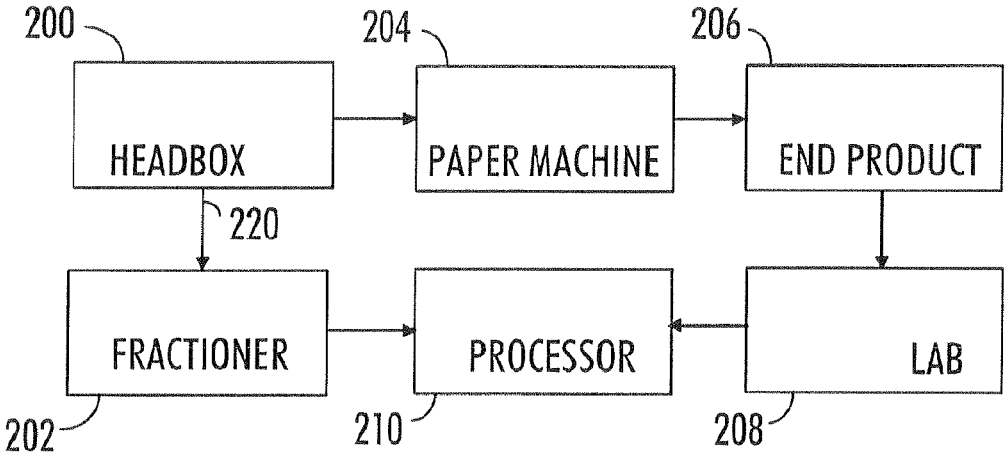
FIG. 2 shows the principle of generating a model.

FIG. 2 shows, in accordance with an embodiment of the invention, an arrangement implementing generation of a model. A sample 220 is taken from liquid fibre pulp which is to be conveyed into a headbox 200 or has proceeded into it and which is used for manufacturing an end product 206. The sample 220 may be taken to a fractionator 202, for example, where the sample 220 may be arranged in accordance with hydrodynamic flow resistance of the particles. At least one property is determined from the sample 220 with at least two particle sizes at a moment of time T1. In accordance with the embodiment, at least one property is determined from the end product 206 at a moment of time T2, which is later than the moment of time T1. Further, a model based at least on the determined at least one property of the end product 206 and at least one property of the sample 220 is generated. The model may be used for modelling the end product 206 or for controlling the manufacturing process of the end product 206.

The fractionator may be similar to the one shown in FIG. 3, and its operation will be described next. The liquid fibre pulp sample may be fed via a valve 302 into a tube 304, where the pressure, flow and temperature of the water pushing the sample forwards is controlled by means of a regulator 300. The tube 304 carrying out the fractionation may be of an arbitrary length and thickness. The length of the tube may even be dozens or hundreds of meters, and the diameter of the tube may even be dozens of centimeters. Preferably, however, the diameter of the tube is as small as possible, even less than a millimeter. The tube 304 may be manufactured of polymer, such as plastic, metal etc.

When the sample is flowing in the tube 304, the particles of the solid matter of the sample become arranged according to the particle size in such a way that the greatest particles are collected in the front part of the sample, the smallest particles being collected in the rear part of the sample. Large particles thus flow more rapidly than small particles. The particles of the sample may be arranged in fractions according to the particle size, each of the fractions containing particles between the desired upper limit and the desired lower limit. In this way, in accordance with an embodiment, the particles of the sample are arranged according to the particle size, i.e. according to the hydrodynamic flow resistance of the particles. Parameters expressing properties of the fibres in the sample include, for example, the length of the fibre, the length distribution of the fibres, the number of fibre bundles, optical properties of the fibres, such as brightness, RI value (Residual Ink) or colour, width of the fibre, wall strength of the fibre, linear density, amount of fines, crimp of the fibre, external fibrillation of the fibre, electrical conductivity and permittivity of the fibres and sound velocity in the fibres.

If desired, fractions may be taken from the samples into sample receivers 314 to 320, and there may be N sample receivers, where N is a positive integer number and N is equal to or greater than 2. Each of the fractions in the sample receiver 314 to 320 may be measured in a laboratory, or the fractions may be measured in the same way as the sample flowing in the fractionating tube 304, using one or more measuring methods.

Thus, in accordance with an embodiment, at least one property of the sample is determined with at least two different particle sizes at a moment of time T1. In accordance with an embodiment, at least one property may be measured from the sample receiver 314 to 320 by performing measurements from at least two sample receivers 314 to 320. In accordance with an embodiment, at least one property may be measured from a sample in the fractionating tube by performing measurements from at least two points of the fractionating tube. Alternatively, at least one property may be determined from one point of the fractionating tube at two different moments of time, whereby at the latter moment of time, a group of particles of different sizes has moved to the measuring point of the fractionating tube. The measuring point of the fractionating tube may be a gate-like measuring point where the desired measurements to find out at least one property can be performed. The fractionating tube may be, for example, transparent. Further, different ways of determining at least one property may be combined in such a way, for example, that one property is measured directly from the fractionating tube, another property being measured from the sample receiver 314 to 320. Fractionation may be performed with either what is called a tube flow fractionator or with what is called a field flow fractionator. It is also feasible to implement the fractionation by using an ultrasound or movement field, such as in the cyclone principle.

Typically, the particle sizes separated by the fractionator are divided into very small batches. Consequently, there is a very large number of fractions with different particles sizes at the output of the fractionator. In accordance with an embodiment, that number of fractions for which at least one property is calculated is reduced. In other words, the dimension of the output data is reduced. Reduction may be such, for instance, that at least one property is calculated for only 30 fractions of the original exemplary 3 000 fractions. Any other reduction ratio is also feasible.

The at least one property of the sample may express consistency information as a function of the volume of the liquid fibre pulp having flown through the fractionating tube. Further, the at least one property of the sample may express how much fibre or filling agent there is in the liquid fibre pulp.

Thus, a fractionator is an apparatus dividing the pulp sample into continuous fractions with the principle of tube flow fractionation. The concentration and/or optical properties of these fractions may be measured by using an electrochemical, optical, electromagnetic or mechanical transmitter, such as a kajaaniRM3™ transmitter manufactured by Metso Automation. A kajaaniRM3 transmitter transmits light at a given wavelength towards an object to be examined, such as, in this case, towards a sample separated by a fractionator and having a given particle size. The ash content of the sample, for example, can be expressed by means of a kajaaniRM3 transmitter. Of course, other optical transmitters may also be used instead of a kajaaniRM3 transmitter. Further, in accordance with an embodiment, several different transmitters may be switched on simultaneously and used for determining at least one property of a sample.

In accordance with an embodiment, at least one optical property is determined from the sample with at least two different particle sizes. The optical property can be found out by using an optical transmitter, such as a kajaaniRM3 transmitter. With an optical transmitter, optical signals with a desired wave length may be transmitted towards an object to be examined. By means of the signals, at least one optical property can be found out, the property being, in accordance with an embodiment, at least one of the following: absorption of light, scattering of light and depolarization of light. Other optical properties, such as reflection of light, may also be utilized. Light refers here not only to visible light (wavelength of 400 nm to 700 nm) but also to other optical radiation. Thus, light refers to all optical radiation with a wavelength of 50 nm to 5 000 nm.

Absorption of light means "soaking" of light into an object to be examined, i.e., in this case, absorption of light into a sample with a given particle size. Scattering of light means that when arriving in the sample, light is scattered in several different directions. Scattering results from the refractive index of the particles and liquid in the liquid fibre pulp sample. Depolarization of light (birefringence) expresses how much the polarization plane of light turns. In this case, depolarization expresses how birefringent the sample pulp is. In other words, when the vibration frequency of light relative to the direction of propagation favours another type of polarization, for example vertical polarization, the molecules in the sample pulp may turn the polarization plane of the light when this type of light hits the sample pulp. The crystalline cellulose molecules in the fibres of the sample pulp are thus birefringent, so they can turn the polarization plane of the light. The more there are such molecules, the more the polarization plane turns. Therefore, depolarization of light expresses the amount of fibres, crystalline cellulose etc. in the sample pulp.

Each of these three optical properties, such as optical properties in general, is affected by the wavelength of the optical signal used. Therefore, in accordance with an embodiment, at least one optical property is determined by at least two wavelengths of the light used for determining the optical property. The wavelengths used may be arbitrarily selected. The wavelengths used may be, for example, a given wavelength of laser light and a given wavelength of LED light (LED=light emitting diode).

The at least one property of the sample, measured with at least two different particle sizes, may be, instead of an optical property, for instance capability of the sample to conduct electricity. Thus, the at least one property may also express the electrical conductivity of the liquid fibre pulp sample with a given particle size. Further, both an optical property and another property, such as electrical conductivity, may be measured from the sample, and both of these properties may be utilized.

Figure 3:
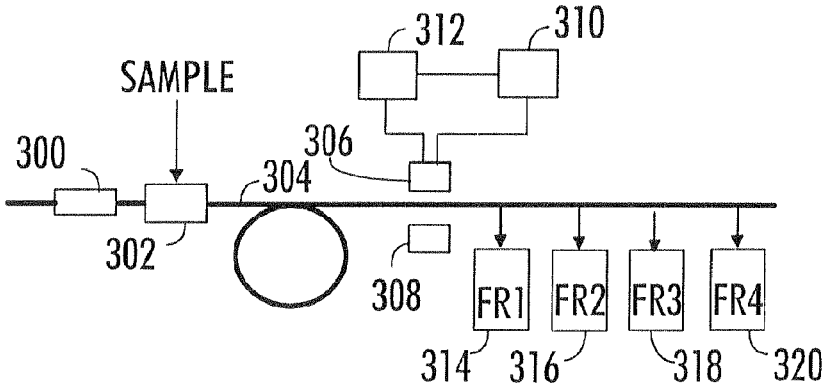
FIG. 3 shows the structure of a fractionator.

Let us examine FIG. 3 in more detail. For determining at least one optical property, the arrangement of FIG. 3 comprises at least one processor with which changes in the optical signal can be examined when the signal meets the flowing sample for instance in the transparent fractionating tube. A source 308 of optical radiation may be arranged to generate optical signals at a given wavelength, and a processor may determine how the optical properties of light change when hitting the flowing sample. An optical signal means here electromagnetic radiation having a wavelength which has been selected arbitrarily.

The processor may be, for example, a camera 306. There may be one or more cameras 306. From the camera 306, the image or images may be transferred to an image processing unit 310, in which the image or images may be transferred to a display 312. The image may be displayed as, for example, a grey-shade image or as a colour image. The image processing unit 310 comprises a processor, memory and one or more computer programs required for executing the image processing. An image or images may also be transferred to the display 312 directly from the camera 306 without any processing that would be executed in an image processing unit 310. Each image may a still image or a video image. Each still image may represent one fraction, or an image showing one fraction may be selected from a group of images. A video image, in turn, may be a sequence of still images, showing shots from the starting end to the final end of the sample. Then, when one proceeds from the first image (the image of larger particles at the starting end of the sample) onwards image by image, the average size of the particles decreases. Further, the consistency of the fractions may be measured optically by utilizing attenuation of optical radiation and possibly also a change in the polarization.

The source 308 of optical power may be a LED, filament lamp, gas-discharge lamp, laser etc., and the source of optical power may illuminate the object in a pulsed manner or continuously. The camera 306, which may be, for example, a CCD camera (Charge Coupled Device) or a CMOS camera (Complementary Metal Oxide Semiconductor) takes an image or images of the liquid fibre pulp sample in the tube 304 either on the same side where the source 308 of optical power is or on the opposite side.

The at least one property may be determined on the basis of the spectrum of optical radiation reflected by each fraction. The particle colour, brightness etc. and thus the desired parameter to be measured can be determined from the spectrum.

The optical measurements of the particle properties may thus be performed for instance spectroscopically or by means of image analysis, and the measurements may be directed at the flowing sample or the sample receivers for fractions. The optical measurements may be, in accordance with an embodiment, absorption, reflection or scattering measurements which may utilize polarization of optical radiation.

In accordance with an embodiment, the at least one property of the sample may also be measured without using a fractionator. The principle is that at least one property is determined from two or more fractions of the liquid fibre pulp, which property may be, for example, an optical property or the capability of the sample to conduct electricity, as explained above. The determined at least one property may then be used for modelling the end product and controlling the process. Determination of the at least one property with at least two different fractions may take place from the measured signal instead of a fractionator.

Let us re-examine FIG. 2. As described above, the liquid fibre pulp is moved from the headbox to other parts of a paper machine 204, such as onto the wire, to the drying mechanism and finally to be formed as the end product 206. The end product may be, for instance, paper, paperboard or board. In accordance with an embodiment, at least one property is determined from the end product 206 at a moment of time T2 which is later than the moment of time T1 in such a way that the time constants affecting the manufacturing process have been taken into account.

The moment of time T2 is dependant on the moment of time T1 in such a way that the moment of time T2 is the moment at which the liquid fibre pulp, from which fibre pulp a sample 220 has been taken and from which sample 220 at least one property has been determined, has moved from the sampling location of the sample 220 through the paper machine to be formed as the end product. In other words, the moment of time T2 is affected by the length of the paper machine and the speed of the paper machine to move the pulp. In accordance with an embodiment, T2=T1+(length of the paper machine divided by the travelling speed of the material).

The at least one property of the end product 206 may be a paper-technical property, such as the tensile strength, roughness of the surface, glossiness of the surface, basis weight, moisture, colour etc. The property may be determined from the end product, such as from a paper reel, paperboard or board by using, for example, a laboratory tool 208 or other measurement. This may be, for instance, a PaperLab measuring device.

The property may also be determined from the end product of a part of the paper machine 204, such as from the web, after a part of the paper machine 204 by utilizing measuring devices 116 to 120 in FIG. 1.

When at least one property of the end product and at least one property of the liquid fibre pulp used for manufacturing the end product are known, this information may be utilized when constructing a model with which properties of the pulp at the current moment to generate a particular paper-technical property can be determined. In this way, in accordance with an embodiment, a model is generated which is based on at least the determined at least one property of the end product 206 and at least one property of the sample. In other words, a processor 210 may generate, on the basis of the determined at least one property of the end product and at least one property of the sample 220 with at least two particle sizes, a model with which at least one property of the end product is determined when at least one property of the liquid fibre pulp is known. Thus, the model may be used in soft sensor modelling. Soft sensor modelling means a method in which several pieces of information are processed together, producing computationally new information by means of this joint processing.

After this, in accordance with an embodiment, a new sample 220 is taken from the liquid fibre pulp used for manufacturing the end product 206, and the particles of the sample 220 are arranged according to the particle size, so that at least one property of the sample 220 can be determined from it with at least two different particle sizes at a moment of time T3 which is later than the moment of time T2. Next, at least one property of the end product 206 is determined on the basis of the generated model when at least one property of the sample 220 is known, at a moment of time T4 which is later than the moment of time T3.

The model may be constructed on the basis of data collected mathematically. The model may be based on statistics about properties of the end product and the paper pulp. Alternatively, the model may also be generated by using known methods, such as MLP (Multi-Layer-Perception), ICA (Independent Component Analysis) or the like.

Compiling a model M is based on grouping the collected fraction-specific properties and utilizing them in making the model M. Of a variable group that may contain, for example, a given number of variables for each one of a given number of fractions, a model M can be constructed for connecting a property of the paper pulp and a property of the end product with each other. A given number of variables may be five, for example, containing absorption $A_1$, reflection $S_1$ and depolarization $D_1$ of light at one wavelength of light, and absorption $A_2$, reflection $S_2$ of light at another wavelength of light. If the number of fractions for which the variables are calculated is, for example, (after potential reduction), the number of total variables in generating the model M is in this case 30×5=150 variables. At least one property e determined from the end product corresponds to this variable group J.

A plurality of values may be determined for each variable as a function of fractions, such as a change in depolarization as a function of the particle size (fraction) when using a given type of wavelength. A property (variable) to be determined from a liquid fibrous sample may be selected in such a way, for instance, that the aim is to find such a variable that values obtained from it as a function of fractions contain as little noise as possible. The selected variables may also be predetermined without the above-mentioned examination of the amount of noise.

In accordance with an embodiment, the model is linear. Thus, a linear model M is constructed of the variable group, measured against at least one property e. This may be done in such a way, for example, that the variable e=M·J, where · denotes the dot product between the model vector M and the determined variable vector J. In accordance with the previous example where there are 30 fractions and 5 variables per fraction, the following equation can be formed for property e:

$$e = \sum_{i=1}^{30} A_{1,i} M_i + \sum_{i=1}^{30} D_{1,i} M_{i+30} + \sum_{i=1}^{30} S_{1,i} M_{i+60} + \sum_{i=1}^{30} A_{2,i} M_{i+90} + \sum_{i=1}^{30} S_{2,i} M_{i+120}, \quad (1)$$

where $M_i$ is the $i^{th}$ element of the model matrix.

In accordance with an embodiment, the model is generated in such a way that at least one constant term is added to it. The constant term c may be added to the model in such a way, for example, that a constant c, i.e. e=c+M·J, is added to the equation of at least one property e of the end product. The constant term allows the model to be easily calibrated. For instance, the location of the zero point can be found for the model by means of the constant term c. The model may be calibrated to, for example, a threshold value of the laboratory tool 208, such as to the tensile strength or tear strength.

In accordance with an embodiment, a model is generated on the basis of yet at least one piece of further information, such as the setting parameter of the paper or paperboard machine or a measured variable, such as the flow, temperature or pressure, optical parameters, such as the colour, brightness or floc formation of the pulp, consistency, turbidity, electrical conductivity, chemical or biological oxygen consumption, acidity or the like. Thus, at least one external piece of information may be added to the model in addition to the at least one property provided by the fractionator and the at least one property determined from the end product. This external piece of information may originate from, for example, an industrial data system or an industrial production system. In other words, the model may further contain at least one piece of information from an industrial data system. Thus, at least one scalar or spectral variable may be added to the model. The piece of information may express, for instance, the position of the nozzles in the headbox 200, information on the equipment in the paper machine 204, such as on the nip pressure, information on the fractionator 202, information on the laboratory tool 208, information on the air humidity, information on the consumption of steam etc.

Thus, the model may be used to predict properties which cannot be predicted otherwise before the end product is finished. In other words, on the basis of the model, the liquid fibre pulp in the headbox may be controlled to be as desired when the desired property of the end product is known. This will be explained by means of FIG. 4.

A customer 414 may inform what kind of given property of an end product 406 the customer 414 wishes to have. A controller 412 may thus be arranged to receive information on at least one desired property of the end product 406. Further, the controller 412 may be arranged to acquire information on the model M connecting at least one property of the end product 406 with at least one property of the liquid fibre pulp used in manufacturing the end product 406. In this context, acquiring information on the model may mean that the controller 412 obtains information on the model from the processor 210 executing the generation of the model, or that the controller itself determines the model M. In the latter case, the processor 210 is not required separately but it may be integrated in the controller 412, or the controller 412 itself may perform the generation of the model M.

In accordance with an embodiment, the controller 412 may control at least one property of liquid fibre pulp to be such that it produces at least one desired property of the end product 406 on the basis of the model M. On the basis of the model, for instance the blade gap of a refiner, energy or feed consistencies can be controlled. Screens can also be controlled to screen fibre pulps in a desired manner by means of the feed consistency or flows, for example. The purpose of these control measures is to standardize changes in the raw material or to control the paper pulp to be such that its properties are of the desired type. The liquid fibre pulp may be located in a headbox 400. The controller 412 may then be used to control the fibre pulp to be of a desired type. For example, the mass potential of the headbox pulp may be the object of the control. Controlling may mean that components 402 before the headbox, such as the refiner, screen and/or chemicals to be fed to the approach line of the headbox 400, are controlled in such a way that the liquid fibre pulp in the headbox 400 is of a desired type. This controlling may be based on the fact that with known distributions of the measured variable (variable vector) J, the production process is stable and energy-efficient or that the properties of the end product are of a desired type. Controlling may also be based on model-based optimization in which the intention is to keep the model predictions in predetermined functional windows. Controlling is based on adjusting measures taken at process stages, such as in refining, screening or chemicalization, which adjusting measures change the distributions of the measured variable J. Further, formation of headbox pulp, such as the recycled fibre process, may be controlled in such a way that the liquid fibre pulp in the headbox 400 is of a desired type. Control/management of the recycled fibre process may refer to controlling the amount of chemicals in the process, use of flotation cells, energy of dispersing or the like. In accordance with an embodiment, the model M is used for at least one of the following: management of the operation of the refiner, management of the operation of the screen and management of the recycled fibre process.

Figure 4:
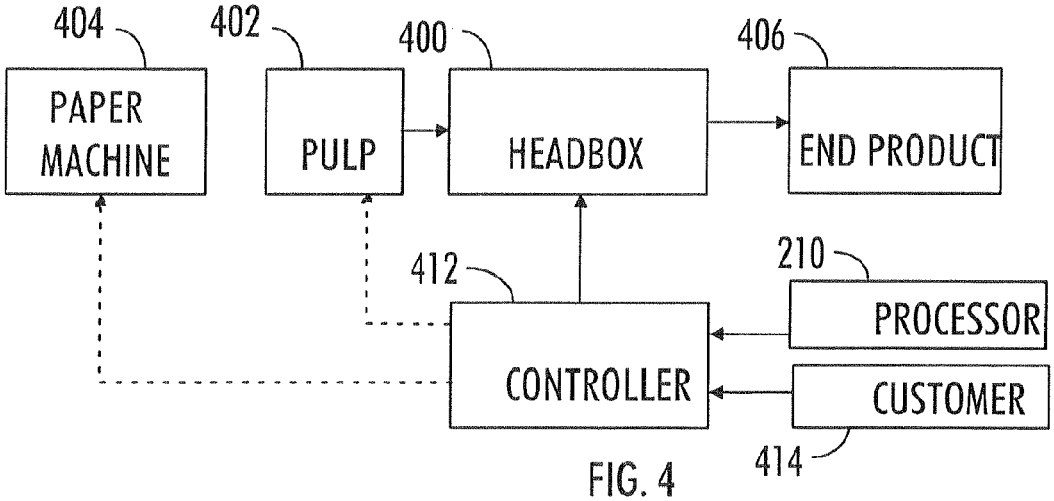
FIG. 4 shows the principle of control.

Further, parts of the paper machine 404 affecting the quality of paper pulp, such as the valves 128, the mixing tank 130 and the machine tank 132 of FIG. 1, may be controlled with the controller 412 of FIG. 4 on the basis of the model in order to obtain paper pulp of a desired type.

The model M may also be utilized in an online process where a process for forming an end product is controlled in real time. Thus, at least one property is calculated from the pulp in the headbox by means of a fractionator at repeated intervals or when desired, and changes in the pulp are responded to in real time by controlling the pulp to be of the desired type, for example in the above-mentioned ways.

Figure 5:
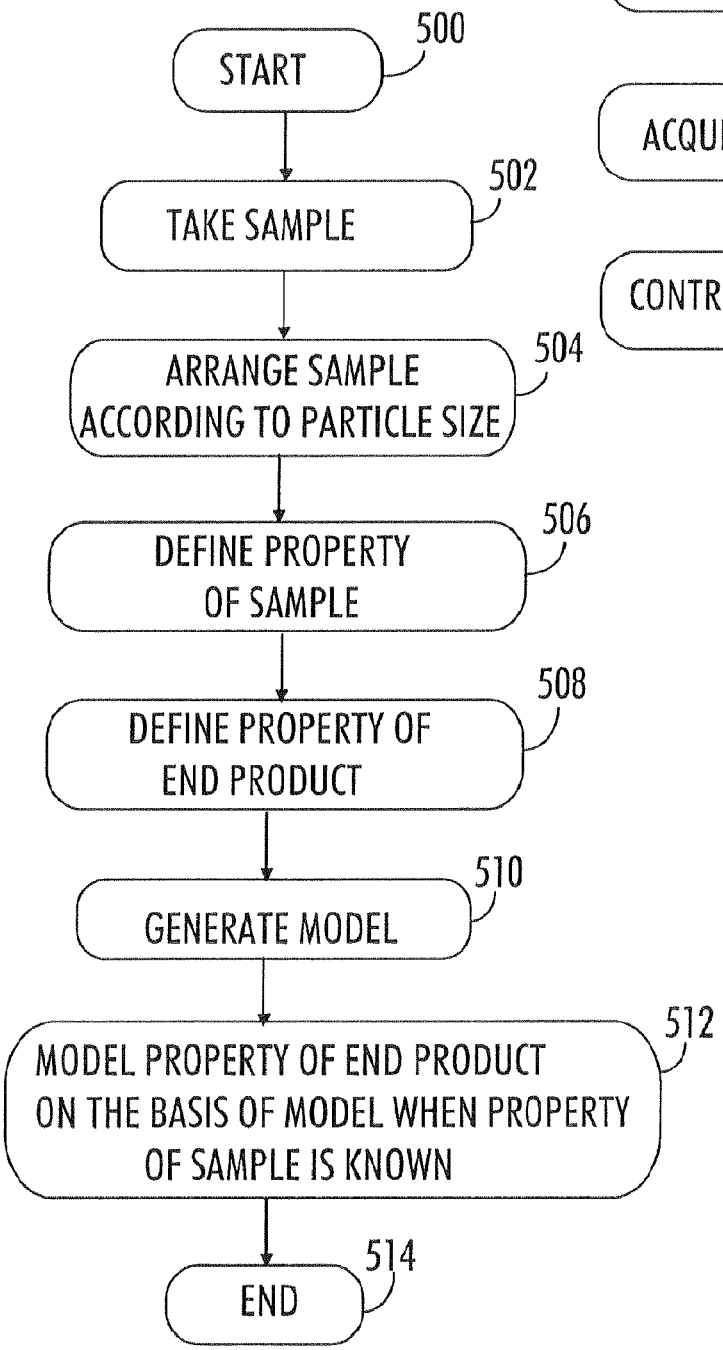
FIG. 5 shows a method of determining a property of an end product by means of a model.

FIG. 5 shows a method of modelling at least one property of paper, paperboard or board which is an end product. The method starts at point 500. At point 502, a sample is taken from liquid fibre pulp used for manufacturing the end product. At point 504, the particles of the sample are arranged according to the particle size. At point 506, at least one property of the sample is determined with at least two different particle sizes at a moment of time T1. At point 508, at least one property is determined from the end product at a moment of time T2 which is later than the moment of time T1. At point 510, a model is generated which is based on at least one property of the end product and at least one property of the sample. At a moment of time T3 which is later than the moment of time T2, at least one property may be determined from a new sample taken from liquid fibre pulp. The liquid fibre pulp may be different from the liquid fibre pulp of the sample taken at the moment of time T1. At point 512, at least one property of the end product is modelled, at a moment of time T4 which is later than the moment of time T3, on the basis of the generated model when at least one property of the sample is known. The method ends at point 514.

Figure 6:
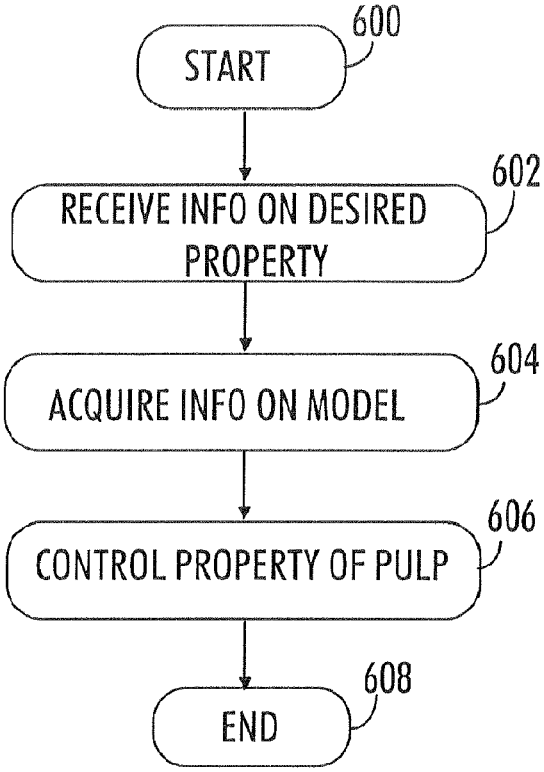
FIG. 6 shows a method of controlling the quality of an end product by means of a model.

FIG. 6 shows a method of controlling the quality of paper, paperboard or board which is an end product. The method starts at point 600. At point 602, information is received on at least one desired property of the end product. At point 604, information is acquired on the model that connects at least one property of the end product with at least one property of the liquid fibre pulp used in manufacturing the end product. At point 606, at least one property of the liquid fibre pulp is controlled, on the basis of the model, to be such that it produces at least one desired property of the end product. The method ends at point 608.

It will be obvious to a person skilled in the art that as the technology advances, the basic idea of the invention may be implemented in a plurality of different ways. The invention and its embodiments are thus not restricted to the embodiments described above but may vary within the claims.

The invention claimed is:

1. An apparatus for use in connection with a paper machine, comprising at least one processor and at least one memory including a computer program code, wherein the at least one memory and the computer program code are configured, with the at least one processor, to cause the apparatus at least to:

receive, at a moment T1, from a sensor, information on a distribution of at least one determined property of a sample of liquid fibre pulp, which is used for manufacturing an end product, as a function of at least two different particle sizes fractionated by a fractionator utilizing hydrodynamic flow resistance of particles, wherein the end product is one of paper, paperboard and board and wherein the sample is taken from the liquid fibre pulp which is to be conveyed into a headbox of the paper machine or has proceeded into the headbox;

receive, at a moment of time T2 that is later than the moment of time T1, from a sensor, information on at least one determined property of the end product;

generate a model based on the determined at least one property of the end product and the distribution of at least one property of the sample of the liquid fibre pulp as a function of at least two different particle sizes, wherein the model connects the property of the end product received at the moment of time T2 to the distribution of the property of the sample of the liquid fibre pulp received at the moment of time T1;

receive, at a moment of time T3 that is later than the moment of time T2, from a sensor, information on a distribution of at least one determined property of the sample of the liquid fibre pulp, which is used for manufacturing the end product, as a function of at least two different particle sizes fractionated by a fractionator utilizing hydrodynamic flow resistance of particles;

model, at a moment of time T4 which is later than the moment of time T3, the at least one property of the end product on the basis of the generated model when the distribution of at least one property of the sample at the moment of time T3 is known;

receive information on at least one desired property of the end product, upon detecting that the modeled at least one property of the end product and the at least one desired property of the end product do not match, perform the following:

control, on the basis of the generated model, components before the headbox of the paper machine such that the distribution of the at least one property of the liquid fibre pulp in the headbox as a function of different particle sizes is such that it produces the at least one desired property of the end product.

2. An apparatus according to claim 1, wherein the processor is arranged to reduce that amount of particle sizes of the sample for which at least one property is calculated.

3. An apparatus for use in connection with a paper machine, comprising:

at least one processor and at least one memory including a computer program code, wherein the at least one memory and the computer program code are configured, with the at least one processor, to cause the apparatus at least to:

receive information on at least one desired property of an end product, wherein the end product is one of paper, paperboard and board; and acquire information on a model which has been generated on the basis of the following:

a distribution of at least one property of a sample of liquid fibre pulp as a function of at least two different particle sizes, wherein a fractionator utilizing hydrodynamic flow resistance of particles is used in dividing the liquid fibre pulp to the at least two different particle sizes, wherein the at least one property is determined from the liquid fibre pulp which is to be conveyed into a headbox of the paper machine or has proceeded into the headbox, and at least one property determined from the end product, wherein the model connects the property of the end product to the distribution of the property of the sample of the liquid fibre pulp; and the apparatus is further caused to:

control, on the basis of the model, the at least one property of the liquid fibre pulp, which is used for manufacturing the end product, to be such that it produces the at least one desired property of the end product, wherein the control comprises controlling components before a headbox of the paper machine such that the distribution of the at least one property of the liquid fibre pulp in the headbox as a function of different particle sizes is such that it produces the at least one desired property of the end product.

4. An apparatus according to claim 3, wherein the controller is arranged to control, by means of the model, at least one optical property of the fibre pulp.

5. An apparatus according to claim 4, wherein the optical property is at least one of the following: absorption of light, scattering of light and depolarization of light.

6. An apparatus according to claim 4, wherein the optical property may be expressed at at least two wavelengths of the light used for determining the optical property.

7. An apparatus according to claim 3, wherein the controller is arranged to control at least one of the following: the operation of the refiner, the operation of the screen and the recycled fibre process.

8. An apparatus according to claim 3, wherein the controller is arranged to control the at least one property of the liquid fibre pulp in real time.

9. A method for use in connection with a paper machine, the method for controlling at least one property of paper, paperboard or board that is an end product and the method comprising:

taking a sample from liquid fibre pulp used for manufacturing the end product, wherein the sample is taken from the liquid fibre pulp that is to be conveyed into a headbox of the paper machine or has proceeded into it;

arranging particles of the sample according to particle size by use of a fractionator utilizing hydrodynamic flow resistance of particles;

determining, at a moment of time T1, a distribution of at least one property of the sample of the liquid fibre pulp, which is used for manufacturing the end product, as a function of at least two different particle sizes fractionated by the fractionator;

determining, at a moment of time T2 that is later than the moment of time T1, at least one property of the end product;

generating a model based on the determined at least one property of the end product and the distribution of at least one property of the sample of the liquid fibre pulp as a function of at least two different particle sizes, wherein the model connects the property of the end product received at the moment of time T2 to a distribution of the property of the sample of the liquid fibre pulp received at the moment of time T1;

taking a sample from the liquid fibre pulp used for manufacturing the end product;

arranging the particles of the sample according to the particle size by use of the fractionator utilizing hydrodynamic flow resistance of particles;

determining, at a moment of time T3 that is later than the moment of time T2, a distribution of at least one property of the sample of the liquid fibre pulp, which is used for manufacturing the end product, as a function of at least two different particle sizes fractionated by the fractionator;

modelling, at a moment of time T4 that is later than the moment of time T3, the at least one property of the end product on the basis of the generated model when the distribution of at least one property of the sample at the moment of time T3 is known;

receiving information on at least one desired property of the end product, wherein the end product is one of paper, paperboard and board;

upon detecting that the modelled at least one property of the end product and the at least one desired property of the end product do not match, performing the following: controlling, on the basis of the generated model, components before the headbox of the paper machine such that the distribution of the at least one property of the liquid fibre pulp in the headbox as a function of different particle sizes is such that it produces the at least one desired property of the end product.

10. A method for use in connection with a paper machine, the method for controlling the quality of paper, paperboard or board that is an end product and the method comprising:

receiving information on at least one property of the end product; and acquiring information on a model that has been generated on the basis of the following:

a distribution of at least one property of a sample of liquid fibre pulp as a function of at least two different particle sizes, wherein a fractionator utilizing hydrodynamic flow resistance of particles is used in dividing the liquid fibre pulp to the at least two different particle sizes, wherein the at least one property is determined from the liquid fibre pulp that is to be conveyed into a headbox of the paper machine or has proceeded into it, and at least one property determined from the end product, wherein the model connects the property of the end product to the distribution of the property of the sample of the liquid fibre pulp; and the method further comprises:

controlling, on the basis of the model, the at least one property of the liquid fibre pulp, which is used for manufacturing the end product, to be such that it produces the at least one desired property of the end product, wherein the controlling comprises controlling components before the headbox of the paper machine such that the distribution of the at least one property of the liquid fibre pulp in the headbox as a function of different particle sizes is such that it produces the at least one desired property of the end product.

* * * * *